United States Patent [19]

Bucher

[11] 4,059,131

[45] Nov. 22, 1977

[54] JACQUARD SELECTION SYSTEM

[75] Inventor: Robert R. Bucher, Winterthur, Switzerland

[73] Assignee: Sulzer Brothers Limited, Winterthur, Switzerland

[21] Appl. No.: 654,784

[22] Filed: Feb. 3, 1976

[30] Foreign Application Priority Data

Feb. 7, 1975 Switzerland ..... 1518/75

[51] Int. Cl.[2] ..... D03C 3/20

[52] U.S. Cl. ..... 139/59; 139/68

[58] Field of Search ..... 139/55, 59, 65, 68, 139/453; 66/25, 50 R; 310/26, 8.5; 139/317, 331

[56] References Cited

U.S. PATENT DOCUMENTS

| | | | |
|---|---|---|---|
| 3,828,826 | 8/1974 | Hurzeler et al. | 139/59 |
| 3,871,415 | 3/1975 | Brenner et al. | 139/59 |

FOREIGN PATENT DOCUMENTS

| | | | |
|---|---|---|---|
| 1,232,630 | 4/1960 | France | 139/59 |

*Primary Examiner*—Henry S. Jaudon

*Attorney, Agent, or Firm*—Kenyon & Kenyon, Reilly, Carr & Chapin

[57] ABSTRACT

The jacquard selection system employs a slider between each multimorphous bending element and jacquard needle to absorb the stress imposed by the needle during a sensing operation. The sliders move within a guide in which they are spaced from the walls of the guide with a clearance. When a needle is to be blocked so as to sense a position of a bending element, the slider is moved by the bending element into the path of the needle so that, on moving, the needle abuts the slider and pushes the slider against the guide wall. The sliders may be mounted on the bending elements by springs or may be movable therewith via a recess which receives the free end or a resilient tip on the free end of the bending elements.

14 Claims, 7 Drawing Figures

JACQUARD SELECTION SYSTEM

This invention relates to a jacquard selection system. More particularly, this invention relates to a jacquard selection system for a weaving machine.

As is known, jacquard selection systems have been known for selecting warp yarns of a weaving machine which are to be moved into a top-shed position and a bottom-shed position. Generally, these selection systems are controlled in accordance with a weave program and comprise multimorphous bending elements and jacquard needles which sense the bending elements. The needles, in turn, cooperate with lifting wires to move the warp yarns. The term "multimorphous bending elements" is intended to denote electro- or magnetostriction elements which are usually in rod form and which are usually made of a ceramic substance, such as lead-zirconate-titanate and which, when acted upon by an external electric or magnetic field, undergo deformations, more particularly bending, transversely of their length.

In conventional systems of this kind, for example as described in Swiss Patent Specification No. 553,860, the bending element is sensed directly by the associated jacquard needle. In other known constructions, for example as described in Swiss Patent Specification No. 552,691, the bending element has a strengthening cap or a blocking spring which the jacquard needle abuts during sensing.

The known constructions, however, have various disadvantages. In the first case, the bending element experiences relatively heavy stressing when sensed by the jacquard needle and tends to break because of the brittleness of the material from which the element is made. In the second case, the bending element has to preform a relatively considerable amount of work to oppose the friction between the spring and the casing of the bending element. Such a spring cannot withstand adequate sensing pressures from the jacquard needle since the spring must be very thin in order to be of reduced weight.

Accordingly, it is an object of the invention to provide a jacquard selection system which does not subject a multimorphous bending element to heavy stressing.

It is another object of the invention to provide a jacquard selection system which is exposed to a minimum of friction during usage.

It is another object of the invention to provide a jacquard selection system wherein individual bending elements need to perform little or no work while being deflected.

It is another object of the invention to avoid stressing of a bending element of a jacquard selection system by a jacquard needle.

Briefly, the invention provides a jacquard selection system which comprises a plurality of multimorphous bending elements, a plurality of jacquard needles each of which is disposed to sense the position of a respective bending element, a guide and a plurality of sliders. Each slider is reciprocally mounted within the guide between each bending element and a respective needle to selectively inhibit a sensing movement of the respective needle. The effect of the guided inhibiting slider is that the individual bending element needs to perform substantially no work while being deflected. The slider can be made adequately strong, so that the jacquard needles can apply adequate sensing forces thereto. The bending element itself is not stressed by the jacquard needle.

The selection system is such that each bending element has a free end which is movable between two positions while each jacquard needle is movably mounted for movement into one of a sensing position and a non-sensing position relative to a bending element. Each slider in the guide is mounted so as to be moved under the influence of a bending element to selectively inhibit movement of a jacquard needle into the non-sensing position. To this end, each slider is moved as the free end of a bending element moves. This may be accomplished by having a slider secured to the free end of a bending element or by having the free end of a bending element received in a slider. The inhibiting effect of each slider is such that when a needle is to "sense", the slider is moved into the path of the needle to inhibit motion. At this time, the slider which has been loosely disposed within the guide is pressed against a wall of the guide so that the force imposed by the needle on the slider is transferred into the guide and not the bending element. When a needle is to be in a "non-sensing" position, the associated slider is moved out of the path of the needle by the bending element.

These and other objects and advantages of the invention will become more apparent from the following detailed description and appended claims taken in conjunction with the accompanying drawings in which:

Figures 1, 2:
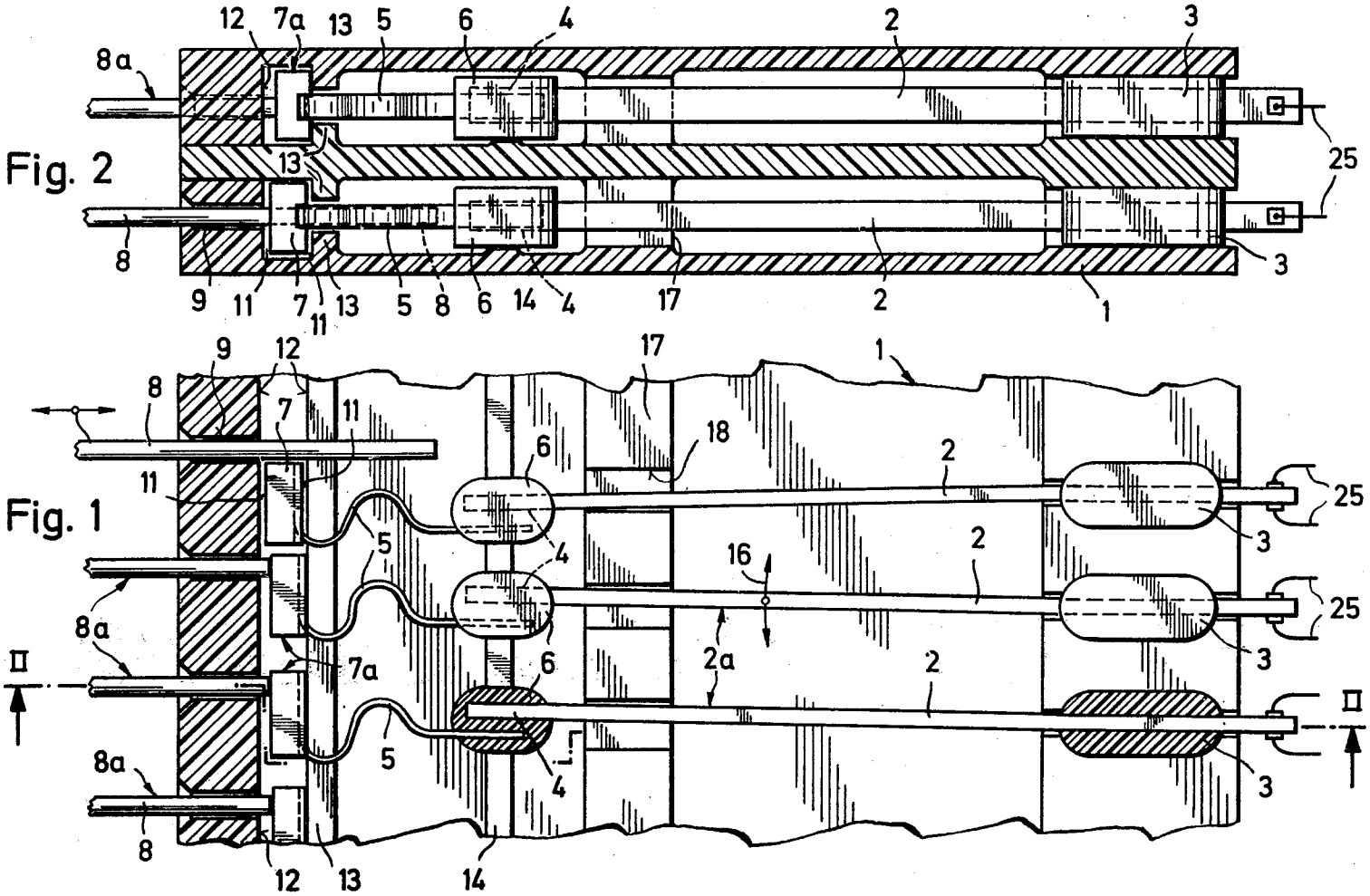
FIG. 1 illustrates a sectional view of a jacquard selection system according to the invention.
FIG. 2 illustrates a view taken on line II—II of FIG. 1.

Referring to FIGS. 1 and 2, a jacquard selection system for selecting warp yarns of a weaving machine (not shown) which are to be moved from a top-shed position to a bottom-shed position includes a casing 1, for example of plastics which is suitably mounted for the purpose intended. The system further includes a plurality of multimorphous bending elements 2 each of which is mounted in the casing 1 via a mounting 3 made, for example of some other plastics, such as araldite, from the casing 1. The free end of each bending element 3 carries an S-shaped spring 5 which is connected to the bending element by an extruded plastics member 6 made, for example, of araldite.

Each bending element 2 is connected to an electric field via an electrical supply wiring 25 so that the free ends of each may be moved between two positions.

The jacquard selection system further includes a plurality of sliders 7 separably mounted from the bending elements 2 and a plurality of jacquard needles 8 as well as a means (not shown) for moving the needles 8 into and out of the casing 1 as is known. As shown, each slider 7 is secured to the end of a spring 5 opposite a bending element 2 while each needle 8 extends via a passage 9 into the interior of the casing 1. The sliders 7 are reciprocally guided within a guide 12 of the casing so as to be moved relative to the passages 9 by the bending elements 2. As shown, each slider 7 is mounted with a clearance 11, shown exaggerated, within the guide 12 so as to be virtually suspended in the guide 12.

Each needle 8 is movable into either a sensing position or a non-sensing position while each slider 7 is movable so as to selectively inhibit a sensing movement of a respective needle 8. To this end, when a slider 7 is moved into an inhibiting or blocking position 7a, as viewed in the lower positions of FIG. 1, the sensing movements of the respective needles 8 are blocked. Thus, the needles become positioned in the sensing positions 8*a*. At this time, these needles 8 push the sliders 7 to the right, as viewed, against a wall 13 of the guide 12. The forces of these needles 8 are then transferred via the sliders 7 and wall 13 into the casing 1 rather than into the bending elements 2. The needles 8 can therefore apply relatively high sensing forces to the sliders 7 without the springs 5 or bending elements 2 being stressed.

When a slider 7 is moved into a non-blocking position, as viewed in the uppermost position of FIG. 1, the sensing movement of a needle is un-inhibited so that the needle 8 may move into the non-sensing position.

Referring to FIG. 1, the bending elements 2 are movable under the electric field from an inoperative position, as shown in the upper positions, into an operative position, as shown in the two lower positions. When the electric field is activated, the bending elements 2 move into the deflection positions 2*a* to inhibit the pressing or sensing movement of the respective needles 8. However, if no electric field acts on the electrostrictive elements 2, the elements remain in the inoperative position so that the respective needle 8 can be moved into a pressing position (i.e. a non-sensing position).

The movement of the needles 8 acts to engage and disengage jacquard lifting wires (not shown) in known manner with and from vertically reciprocating griffes, so that the warp yarns of an associated weaving machine can be moved into a top-shed or bottom-shed position.

Referring to FIG. 2, the casing 1 has a horizontal bearing ledge 14 on which the plastics members 6 can slide and reciprocate in the direction indicated by an arrow 16. Thus, the weight of the free ends 4 of the elements 2, the springs 5, members 6 and sliders 7 is carried on the ledge 14. In addition, a wall 17 is provided in the casing 1 transverse to the elements 2 and is provided with apertures 18 through which the elements 2 pass in order to limit the transverse movements of the elements 2.

Figures 3, 4, 5:
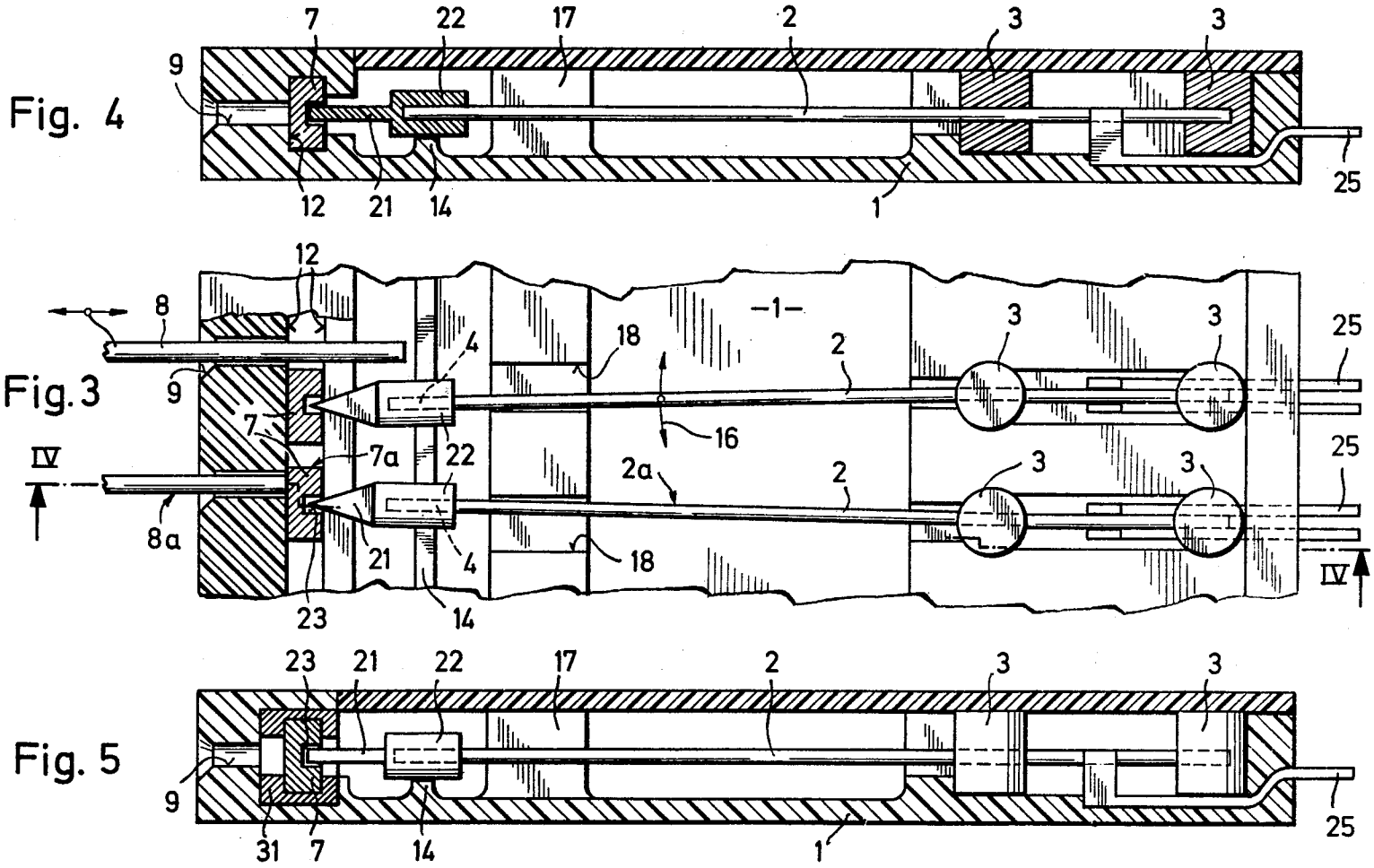
FIG. 3 illustrates a view of a jacquard selection system according to the invention having various modified components.
FIG. 4 illustrates a view taken on line IV—IV of FIG. 3.
FIG. 5 illustrates a view similar to FIG. 4 of a further modified embodiment of a jacquard selection system according to the invention.

Referring to FIGS. 3 and 4, wherein like reference members indicate like parts as above, each bending element 2 is mounted in a pair of spaced-apart mountings 3 of cylindrical shape. In addition, instead of a spring, each bending element 2 carries an extruded plastics top 22 at the free end. Each top 22 has a triangularly shaped tip 21 extending co-axially of a bending element 2. Also, each slider 7 includes a recess 23 which receives a tip 21. In this way, each slider 7 may be moved within the guide 12 under the influence of a movement of a bending element 2 from an inoperative position to an operative or inhibiting position 7*a*.

As shown in FIG. 4, each top 22 slides on a horizontal ledge 14 within the casing 1.

As shown in FIGS. 3 and 4, each bending element 2 is connected at an intermediate point via a pair of leads 25 to an electrical supply source (not shown).

Referring to FIG. 5, wherein like reference characters indicate like parts as above, the guide for the sliders 7 may be formed of a steel guide bar 31 mounted within the casing 1.

Figure 7:
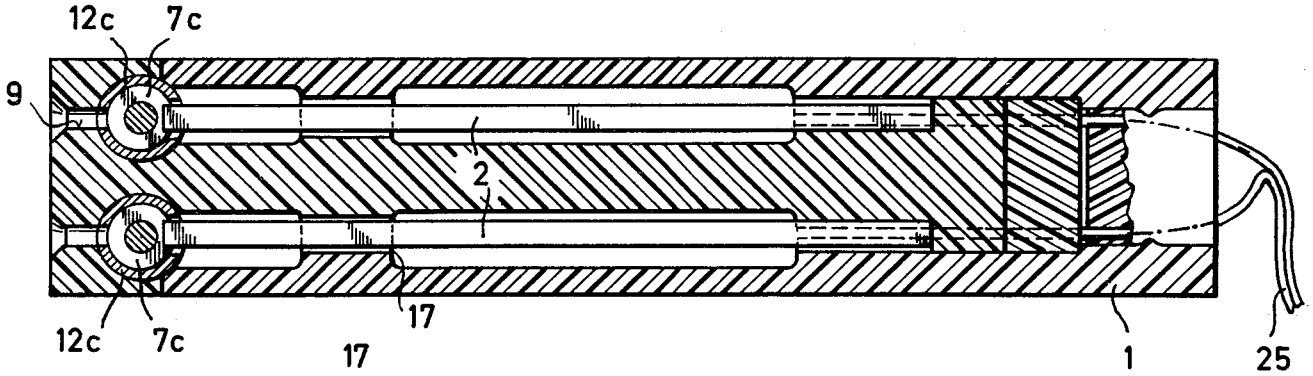
FIG. 7 illustrates a view taken on line VII—VII of FIG. 6.
Figure 6:
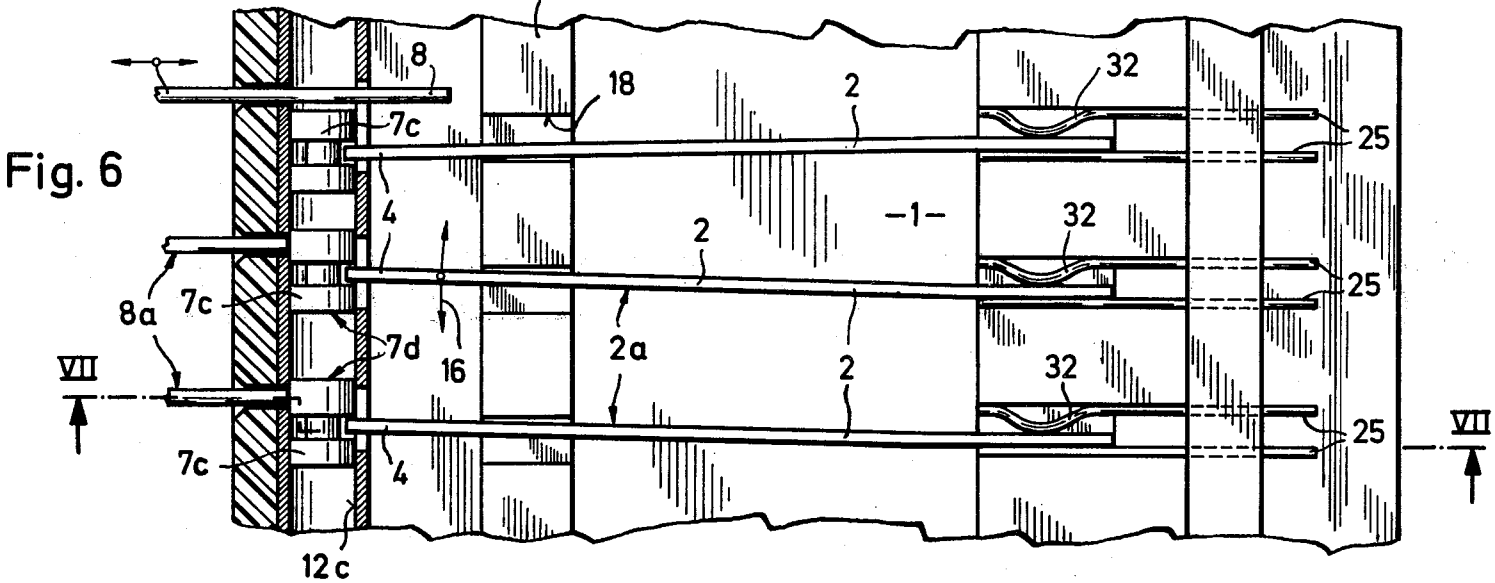
FIG. 6 illustrates a view of a further modified jacquard selection system according to the invention.

Referring to FIGS. 6 and 7, wherein like reference characters indicate like parts as above, the sliders may be in the form of piston-like cylinders 7*c* which can be moved into the blocking or inhibiting position 7*d* directly by the free ends 4 of the bending elements 2. In this embodiment, the guide 12*c* for the sliders 7*c* is a steel cylinder mounted in the casing 1. In addition, the mounted ends of the bending elements 2 are each clamped by a spring 32 which also supplies the voltage necessary to move the element 2.

What is claimed is:

1. A jacquard selection system for selecting warp yarns of a weaving machine, said system comprising:
   - a plurality of multimorphous bending elements,
   - a plurality of jacquard needles, each said needle being disposed to move between a non-sensing position and a sensing position to sense the position of a respective bending element;
   - a guide including a wall opposite said needles; and
   - a plurality of sliders, each said slider being separably mounted from a respective bending element and being reciprocally mounted within said guide between each bending element and a respective jacquard needle to selectively inhibit a sensing movement of said respective needle, each said slider being disposed in abutment with said wall in a sensing position of said respective needle without stressing of a respective bending element.

2. A jacquard selection system as set forth in claim 1 which further comprises a spring connecting each respective bending element to a respective slider.

3. A jacquard selection system as set forth in claim 1 wherein each said slider is disposed in spaced relation to said wall in a non-sensing position of a respective needle.

4. A jacquard selection system as set forth in claim 1 wherein each slider is disposed at a free end of a respective bending element.

5. A jacquard selection system as set forth in claim 1 wherein each bending element has a resilient tip at one end and each respective slider has a recess receiving a tip of a respective bending element.

6. A jacquard selection system as set forth in claim 1 which further comprises a casing housing said bending elements and including a slideway therein and wherein each bending element includes a plastics bearing element near a free end bearing on said slideway.

7. In a jacquard selection system, the combination comprising
   - a casing;
   - a multimorphous bending element disposed in said casing and having a free end movable between two positions;
   - a jacquard needle movably mounted relative to said casing for moving into one of a sensing position and a non-sensing position relative to said bending element; and
   - a slider separably mounted from a respective bending element and being mounted in said casing to move with said bending element to selectively inhibit movement of said needle into said non-sensing position, said slider being disposed in said casing to transfer the force of said needle into said casing with said needle in said sensing position without stressing of said bending element.

8. A jacquard selection system as set forth in claim 7 which further comprises a spring connected to a free end of each respective bending element and secured to a respective slider.

9. The combination as set forth in claim 7 wherein said slider has a recess receiving said free end of said bending element.

10. A jacquard selection system for selecting warp yarns of a weaving machine, said system comprising:

a plurality of multimorphous bending elements, a plurality of jacquard needles, each said needle being disposed to sense the position of a respective bending element;

a guide;

a plurality of sliders, each said slider being reciprocally mounted within said guide between each bending element and a respective jacquard needle to selectively inhibit a sensing movement of said respective needle without stressing of a respective bending element; and a plurality of springs, each spring being connected to a free end of a respective bending element and being secured at an opposite end to a respective slider.

11. A jacquard selection system for selecting warp yarns of a weaving machine, said system comprising a plurality of multimorphous bending elements each having a resilient tip at one end;

a plurality of jacquard needles, each said needle being disposed to sense the position of a respective bending element;

a guide; and a plurality of sliders, each said slider having a recess separably receiving a tip of a respective bending element and being reciprocally mounted within said guide between each bending element and a respective jacquard needle to selectively inhibit a sensing movement of said respective needle.

12. A jacquard selection system for selecting warp yarns of a weaving machine, said system comprising a casing including a slideway therein;

a plurality of multimorphous bending elements in said casing, each said element including a plastics bearing element near a free bearing on said slideway;

a plurality of jacquard needles, each said needle being disposed to sense the position of a respective bending element; and a plurality of sliders, each said slider being reciprocally mounted within said guide between each bending element and a respective jacquard needle to selectively inhibit a sensing movement of said respective needle.

13. In a jacquard selection system, the combination comprising a multimorphous bending element having a free end movable between two portions;

a jacquard needle movably mounted for movement into one of a sensing position and a non-sensing position relative to said bending element;

a guide disposed transversely of said needle; and a slider reciprocally mounted in said guide to move with said bending element to selectively inhibit movement of said needle into said non-sensing position, said slider having a recess separably receiving said free end of said bending element.

14. A jacquard selection system for selecting warp yarns of a weaving machine, said system comprising:

a plurality of elongated multimorphous bending elements, a plurality of jacquard needles, each said needle being disposed to move between a non-sensing position and a sensing position to sense the position of a respective bending element;

a guide including a wall opposite said needles and perpendicular to said bending elements; and a plurality of block-like sliders, each said slider being separably mounted from a respective bending element within said guide between each bending element and a respective jacquard needle to selectively inhibit a sensing movement of said respective needle, each said slider being moveable in perpendicular relation to said bending elements in response to a bending of a respective bending element and being disposed in abutment with said wall in a sensing position of said respective needle.

* * * * *

UNITED STATES PATENT AND TRADEMARK OFFICE

CERTIFICATE OF CORRECTION

PATENT NO. : 4,059,131

DATED : November 22, 1977

INVENTOR(S) : Robert R. Bucher

It is certified that error appears in the above-identified patent and that said Letters Patent are hereby corrected as shown below:

Column 1, line 37, change "preform" to -- perform --

In the Claims

Column 6, line 3, after "free" insert -- end --

Signed and Sealed this

Ninth Day of May 1978

[SEAL]

Attest:

RUTH C. MASON
Attesting Officer

LUTRELLE F. PARKER
Acting Commissioner of Patents and Trademarks